US005255465A

United States Patent [19]

Perez

[11] Patent Number: 5,255,465

[45] Date of Patent: Oct. 26, 1993

[54] MULTIPLE DISPLAY SIGN ASSEMBLY

[76] Inventor: Hector Perez, 1946 NW. 93rd Ave., Miami, Fla. 33172

[21] Appl. No.: 894,457

[22] Filed: Jun. 5, 1992

[51] Int. Cl.[5] ..... G09F 11/02

[52] U.S. Cl. ..... 40/505; 74/435; 40/504

[58] Field of Search ..... 40/503, 504, 505, 506; 74/38, 39, 435

[56] References Cited

U.S. PATENT DOCUMENTS

| | | | |
|---|---|---|---|
| 1,382,311 | 6/1921 | Nowlin | 40/505 |
| 4,002,022 | 1/1977 | Lopez | 40/470 X |
| 4,168,587 | 9/1979 | Falk | 40/505 X |

FOREIGN PATENT DOCUMENTS

| | | | |
|---|---|---|---|
| 662098 | 3/1929 | France | 40/505 |

*Primary Examiner*—Kenneth J. Dorner
*Assistant Examiner*—Brian K. Green
*Attorney, Agent, or Firm*—Malloy & Malloy

[57] ABSTRACT

A multi-display sign assembly, which is particularly lightweight, may be hung in a variety of locations which could not normally support such a sign structure, and functions in smooth, quiet, and relatively low vibration movements, the sign assembly including a frame structure having a pair of support bars, and a plurality of elongate, lightweight triangular members rotatably held between the support bars by axle bars which extend longitudinally through the triangular members and protrude through the support bars. A motor is connected to a reducer which regulates the RPM's of a drive gear connected thereto, the drive gear including teeth only along 120 degrees of its exterior surface such that when the teeth engage a secondary gear which is connected to the axle bar of one of the triangle members, that triangle member will rotate resulting in a new display face of all of the triangle members rotating to form a new one of three distinct display surfaces containing advertising or like indicia thereon.

5 Claims, 3 Drawing Sheets

MULTIPLE DISPLAY SIGN ASSEMBLY

BACKGROUND OF THE INVENTION

1. Field of the Invention

The present invention is directed towards a multi-display sign assembly, which is particularly lightweight, may be made almost entirely of plastic, moves in a smooth or fluid manner, and may be made in a variety of sizes, thereby enabling the assembly to be effectively used to maximize advertising space in locations such as the side of a bus, on a wall, or any other location where a substantially heavy display assembly, or a rough moving assembly, could not be utilized.

2. Description of the Prior Art

Advertising sign assemblies are a very highly used means of passing on advertising messages to the general public. In fact, advertising displays may be found in practically all public locations where there is a free space. Accordingly, the advertising display art, and more particularly the multi-sided advertising display art is a particularly crowded art, wherein even the smallest variations may be of great significance.

Of particular success are sign displays which use triangular segments to enable three billboard type displays to be sequentially shown on a single structure. Beginning with the patent granted to Tetsuo Aoyama, et al., U.S. Pat. No. 3,307,170 granted Feb. 28, 1967, triangular, multi-faced indicators have been utilized, but have had highly complex inter-workings to regulate the turning of particular triangle portions, these many moving parts increasing the possibility of breakdown and the difficulty of repair. In an attempt to simplify the complicated sign construction, the patent to Werner U.S. Pat. No. 3,387,394, granted Jun. 11, 1968 utilized elongate triangular members. This assembly, however, utilized a plurality of gears to drive each individual triangular unit, thereby requiring a powerful motor and a means of regulating the display sequences, and was accordingly heavier and included many gears, which often move in a rough and erratic manner and are susceptible to derailment or breakage. In an attempt to reduce the large number of gears utilized to rotate traditional displays the reference to Ahlgren U.S. Pat. No. 4,189,859, granted Feb. 26, 1980 deviated from prior designs in that it utilized a series of interconnected belts in order to rotate each of the triangular units. This alternative means of driving and rotating the individual triangular units, while removing a large number of gears, could be easily susceptible to breakage of a particular belt, which would be very difficult to replace in such an occurrence, and would require a motor of substantially large power to drive the large number of interconnected belts. Additionally, multi-faced displays such as those in Abbema U.S. Pat. No. 3,826,027 and Ahlgren U.S. Pat. No. 4,528,763 have attempted to maximize the amount of advertising which may be displayed and facilitate the interchanging thereof, but do not address the problems and needs of the drive system. More particularly, past designs require additional timing controls to regulate the rate of rotation of the displays, utilize a large number of intricate workings, such as numerous belts or numerous gears, which often cause rough and/or erratic rotation of the triangle units, and require motors of larger sizes, all of which result in a higher frequency of malfunction or breakdown and make fixing the assembly much more complicated. Further, known displays are not easily adaptable for lightweight construction and smaller construction, thereby limiting their use to a traditional billboard type display. The device of the present invention attempts to overcome all of the deficiencies of the prior art by minimizing the number of small moving elements and utilizing primarily sturdy rigid means of interconnections which will minimize wear on the apparatus, be largely free from breakage, provide fluid motion, and be easily replaced and/or maintained. The assembly of the present invention provides a sign display which is much more effective and has many more uses than the traditionally known, more complex multi-faced displays known in the art.

SUMMARY OF THE INVENTION

The present invention is directed towards a multi-display sign assembly which is easy to maintain, can be made of a highly lightweight construction, includes inner workings that move in a fluid and smooth manner, and will not be easily susceptible to breakage or jamming. The sign assembly primarily includes a frame structure having a pair of support bars therein. Rotatably suspended between the support bars are a plurality of elongate, lightweight triangular members. Each of these triangular members includes an axle bar extending longitudinally therethrough which protrudes through the support bars, accordingly supporting the triangle member. The axle bars are structured such that their rotation will result in the rotation of the triangle members through which they pass. Extending from a distal end of each of the axle bars is a crank member. Each of the crank members is connected at a distal end thereof to an elongate connector bar such that when one of the crank members is caused to rotate, all of the other crank members will simultaneously rotate the same amount. In order to facilitate the smooth movement of the connector bar, a pair of parallel guide bars are included. The guide bars include a central guide bar and a fixed guide bar, the fixed guide bar being attached to the frame structure. The central, moving guide bar is pivotally attached to the connector bar and the fixed guide bar at each opposite distal end thereof by a pair of scissor connectors, thereby assuring that the connector bar will always remain parallel to the fixed guide bar and accordingly, the frame structure wall. Mounted within the frame structure is a motor which includes a reducer connected thereto. The reducer acts to regulate and lessen the RPM's resulting from the motor, thereby enabling a standard low powered motor to be utilized. Connected to the motor through the reducer is a drive gear. Additionally, a secondary gear is fixedly secured to a proximal end of one of the axle bars such that when the secondary gear is turned, the axle bar will turn an equal distance. The drive gear and the second gear are matingly positioned adjacent one another. The drive gear, however, includes teeth only along 120 degrees of its exterior surface, thereby causing the secondary gear to turn 120 degrees only when the teeth rotate to engage the teeth of secondary gear. As a result, the RPM's as regulated by the reducer will dictate when each triangle member will make a 120 degree turn exposing a new face. Each of three faces of the triangle member is part of one of three distinct display surfaces, only one of which is exposed at one time. In order to enable lightweight construction, the majority of component elements of the present invention may be formed of a lightweight, yet sturdy material so as to enable the frame structure to be hung and displayed in numerous locations incapable of holding heavy structures.

It is an object of the present invention to provide a display assembly which is simply constructed, yet highly effective.

Still another object of the present invention is to provide a display assembly which is simply constructed so as to minimize malfunction or jamming thereof, and maximize smooth, fluid rotation of the triangle members.

A further object of the present invention is to provide a display assembly which can be constructed in varying sizes and of lightweight material, thereby maximizing locations in which it may be used.

An additional object of the present invention is to provide a display assembly which requires no additional timing element and enables all portions to move in a smooth, synchronized manner without the need of a high powered motor.

BRIEF DESCRIPTION OF THE DRAWINGS

For a fuller understanding of the nature of the present invention reference should be had to the following detailed description taken in combination with the accompanying drawings in which.

Like reference numerals refer to like parts throughout the several views of the drawings.

DETAILED DESCRIPTION OF THE PREFERRED EMBODIMENT

Figure 1:
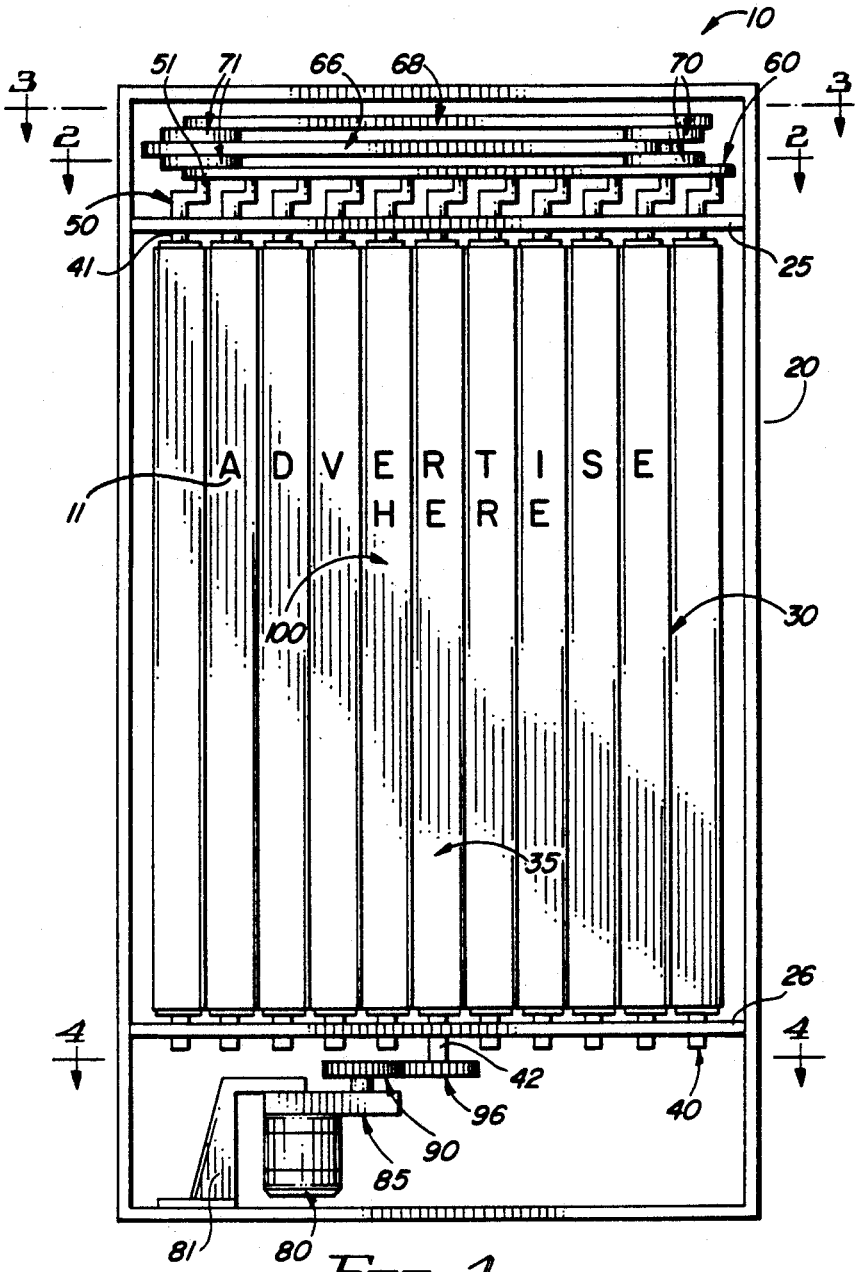
FIG. 1 is a front view of the multi-display sign assembly.
Figure 2:
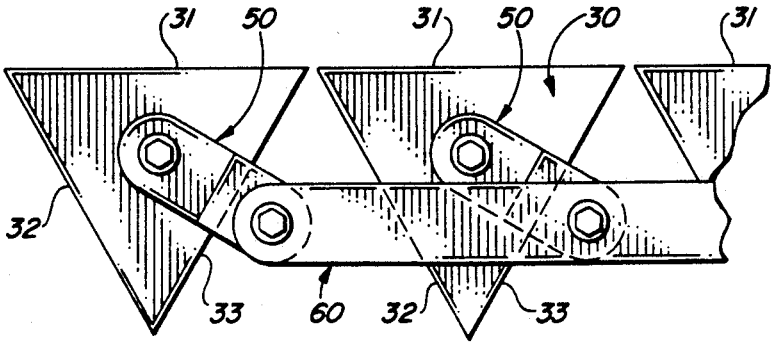
FIG. 2 is a partial top view along line 2—2 of FIG. 1 of the multi-display sign assembly.
Figure 3:
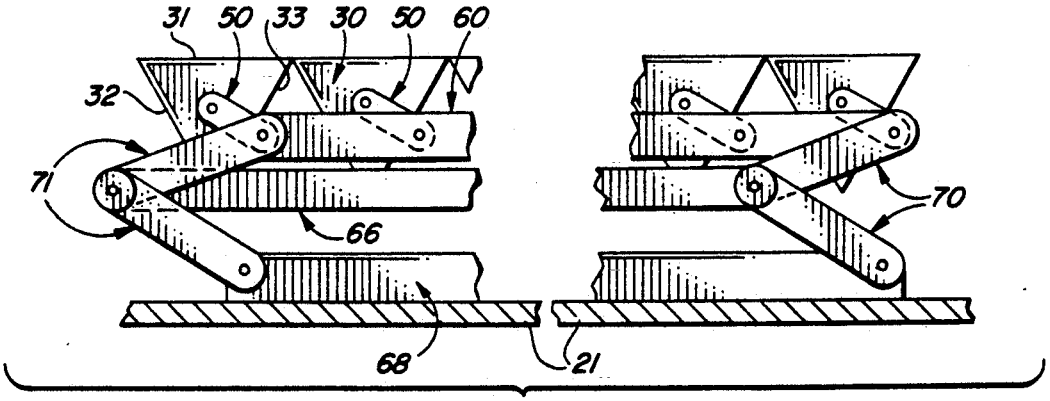
FIG. 3 a partial top view along line 3—3 of FIG. 1 of the multi-display sign assembly.

Shown throughout FIGS. 1 through 5, the present invention is directed towards a multi-display sign assembly, generally indicated as 10, whereon advertising indicia 11 and the like may be conveniently displayed in a variety of locations. Turning to FIG. 1, the multi-display sign assembly 10 primarily includes a frame structure 20 having a pair of support bars 25 and 26 therein. The frame structure 20 functions to house the inner-workings of the sign assembly 10. Disposed between the support bars 25 and 26 are a plurality of elongate, lightweight triangle members 30. Extending longitudinally through a center of each of the triangle members 30 is an axle bar 40. The axle bar 40 is sufficiently elongate such that it protrudes from the triangle member 30 and through each of the support bars 25 and 26, thereby maintaining the triangle members 30 rotatably between the support bars 25 and 26. Each of the axle bars 40 includes a crank member 50 extending from a distal end 41 thereof. The crank members 50 are connected to each of the axle bars 40 such that when each crank member 50 rotates the axle bar 40, and accordingly, the triangle member 30 will rotate. As best seen in FIGS. 2 and 3 all of the crank members 50 are connected at a distal end 51 thereof to an elongate connector bar 60. The crank members 50 are connected to the connector bar 60 such that upon rotation of a single crank member rotates all of the other crank members 50 will simultaneously rotate as a result of their interconnection by means of the connector bar 60 which follows the circular path of movement of the rotating crank member. In order to assure that the connector bar 60 remains in an orientation parallel to a rear face 21 of the frame structure 20 during its movement and that it moves in a smooth and even manner, a pair of guide bars 66 and 68 are included. One of the guide bar 68 is a fixed guide bar which is secured to the rear face 21 of the frame structure 20. Positioned between the fixed guide bar 68 and the connector bar 60 is a central guide bar 66. This central guide bar 66 is connected at each opposite end thereof to the connector bar 60 and the fixed guide bar 68 by means of a pair of scissor type connector pieces 70 and 71. This interconnection of parallel bars assures a fluid and regulated motion with minimal possibilities of malfunction.

Figure 4:
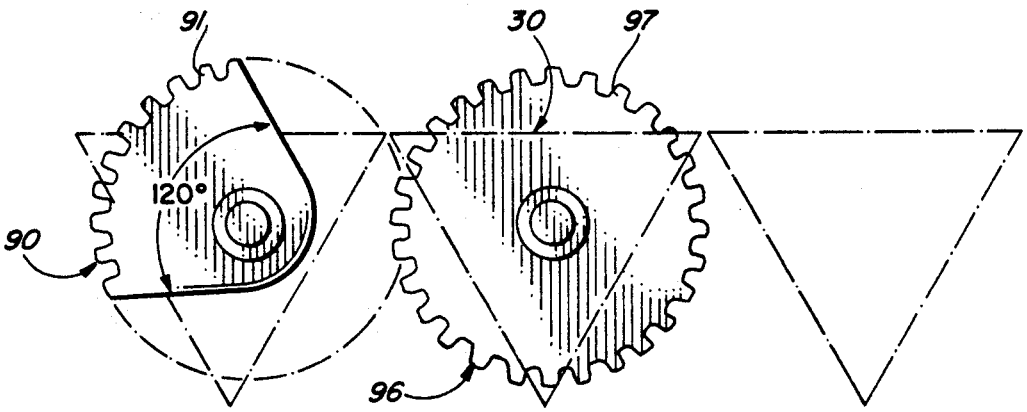
FIG. 4 is a top view along line 4—4 of FIG. 1 of the multi-display sign assembly.

As best seen in FIG. 1, a motor 80 is connected by a bracket 81 to the frame structure 20. This motor 80 may be of relatively low power and may be driven by an external AC or DC power source. Connected to the motor 80 is a reducer 85. The reducer 85 is structured and disposed to lessen and regulate the RPM's produced by the motor 80, thereby regulating the speed at which the triangle members 30 will turn. Connected to the motor 80 through the reducer 85 is a drive gear 90. The drive gear 90, as best seen in FIG. 4, includes gear teeth 91 only along 120 degrees of its surface, or it is cut such that only 120 degrees worth of gear teeth 91 are present. This drive gear 90 is positioned so as to contact and drivingly engage the drive teeth 97 of a secondary gear 96. This secondary gear 96 which is connected at a proximal end 42 of the axle bar 40 of a central triangle member 35, controls the rotation of the axle member which in turn simultaneously causes the rotation of all of the other axle bars 40. Since the drive gear 90 includes teeth 91 only along 120 degrees of its surface, the RPM's as regulated by the reducer 85 will regulate the turning of the triangle members 30. More particularly, each time the teeth 91 of the drive gear 90 engage the secondary gear 96, the secondary gear 96 will rotate 120 degrees causing a new face of each of the triangle members 30 to be exposed. As shown in FIG. 2 each of the triangle members 30 includes three separate faces 31, 32 and 33. Only one of the display faces 31, 32 and 33 may be exposed at one time so as to form a display surface 100 where on the advertising or like indicia may be presented. Accordingly, three distinct display surfaces 100 may be displayed in accordance with which of the faces 31, 32 and 33 of the triangle member 3 is being displayed.

In order to assure that the display assembly is lightweight, each of the triangle members 30 may be made of aluminum. Additionally, the frame structure 20, axle bars 40, connector bar 60, crank members 50, guide bars 66 and 68 and scissor connectors 70 and 71 may be made of plastic or a like lightweight, strong material.

Figure 5:
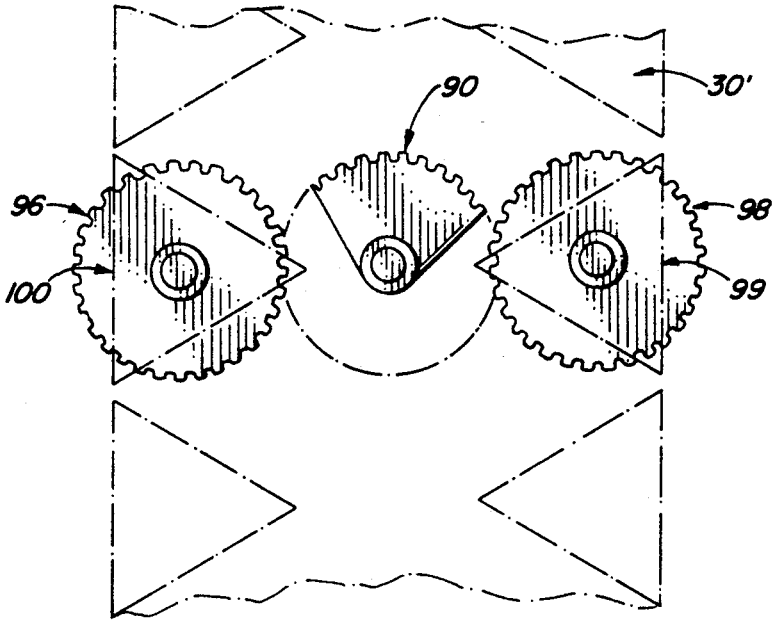
FIG. 5 is a partial top view along line 4—4 of an alternate embodiment of the multi-display sign assembly.

Turning to FIG. 5, in an alternative embodiment, the drive gear 90 may be utilized to drive two secondary gears 96 and 98 resulting in two sets of triangle members 30 and 35 rotating and forming two separate display surfaces 99 and 100.

Thus, this sign assembly permits the presentation of three different messages in sequence by rotation in the same space. It can be used indoors and outdoors, in buildings or in vehicles such as buses, taxis, etc. To set up the sign or to change it, for example, an adhesive spray may be applied on the back of a sheet of poster or paper sign, which has been laid on the triangles which have been previously aligned. Then, the face of the sign is rubbed to make sure the paper has made contact, and then slit with a fine sharp knife, repeating this procedure with the other two faces of the triangles. To change an old sign, the old paper is simply pulled and the procedures with repeated with a new sign. The assembly may be used, for example, at theaters, malls, supermarkets, department stores, travel agencies, hospitals, waiting rooms, product promotion locations, airports, bus stations and bus stops, gas stations, churches, schools, and amusement parks, for any type of promotion, such as car promotions. Signs can be lighted or coupled to music or voice system.

In use, the system works as follows: The motor through a speed reducer turns a gear, which has been shaved off its teeth by 240+ leaving driving teeth for 120°. The rpm's at the reducer end dictate the time that the triangles will stay static forming the picture; for example: at one rpm, the triangles will stay flat for 20 seconds, at two rpm's for 10 seconds, and so on. The intermittent gear engages the drive gear at every revolution making it turn ⅓ of a turn. A gear is fixed to the triangles. Every time the triangles move, their corresponding cranks do too. All cranks are firmly attached to all of the triangles. All cranks are joined together by a connecting bar so every time a crank of a triangle turns by 120°, it drags all other triangles producing the same turn in all of them. The connecting bar is kept straight by a system of parallel bars which are pivoted at both ends by scissor-like members.

Now that the invention has been described,

What is claimed is:

1. A multiple display sign assembly comprising:

a frame structure, said frame structure including a pair of spaced, parallel, horizontal support bars spanning said frame structure, a plurality of elongate, lightweight triangule members, said triangle members each including an axle bar ex tending longitudinally through a center thereof, a rotation of said axle bars resulting in a rotation of said triangle members, said axle bars protruding through said pair of support bars so as to hold said triangle members rotatably between said support bars, each of said axle bars including a crank member protruding from a distal end thereof an elongate connector bar connected to a distal end of each of aid crank members such that when one of said crank members is caused to rotate, all of said crank members equally rotate, thereby resulting in all of said triangle members simultaneously turning, a pair of parallel guide bars, said guide bars including a central guide bar and a fixed guide bar, said fixed guide bar being attached to said frame structure, said central guide bar being pivotally attached to said connector bar and said fixed guide bar at each opposite distal end thereof, by a pair of scissor connectors, a motor mounted within said frame structure, said motor being externally powered, a reducer connected to said motor, said reducer being structured and disposed o regulate and lessen the RPM's resulting from said motor, a drive gear, said drive gear connected to said motor through said reducer so as to turn at a predetermined number of RPM's, a secondary group, said secondary gear being fixedly secured to a proximal end of one of said axle bars so as to result in a turning of said axle bar when said secondary gear turns, said drive gear include teeth only along 120° of its exterior surfaced such that only when said teeth engage said secondary gear will said secondary gear rotate resulting in the turning of said triangle members 120° to expose a new face thereof every time said teeth engage said secondary gear, said triangle members each including three of said faces, only one of said faces being outwardly disposed at one time as part of a display surface upon which indicia is positioned, all of said faces being rotatably positioneable as part of said display surface, thereby enabling three distinct display surfaces to be exhibited, and wherein substantially all of the assembly may be formed of a lightweight, yet sturdy material so as to enable said frame structure o be hung and displayed in numerous locations incapable of holding heavy structures.

2. A multi-display sign assembly as recited in claim 1 wherein said triangle members are made of aluminum.

3. A multi-display sign assembly as recited in claim 2 wherein said frame structure, said axle bars, said crank members, said connector bar, said guide bars, and said scissor connectors are made of said lightweight, yet sturdy material.

4. A multi-display sign assembly as recited in claim 3 wherein said secondary gear is connected to a centrally positioned one of said triangle members.

5. A multi-display sign assembly as recited in claim 4 wherein there are two of said display surfaces on opposite sides of said frame structure.

* * * * *